US007717733B1

(12) United States Patent
Yi et al.

(10) Patent No.: US 7,717,733 B1
(45) Date of Patent: May 18, 2010

(54) CABLE ASSEMBLY HAVING ENHANCED INTERCONNECTION DEVICE THEREOF

(75) Inventors: Chong Yi, Mechanicsburg, PA (US); Pei Tsao, La Habra, CA (US); Jim Zhao, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/316,337

(22) Filed: Dec. 10, 2008

(51) Int. Cl.
*H01R 13/58* (2006.01)

(52) U.S. Cl. ..... 439/452; 439/607.41; 439/607.5

(58) Field of Classification Search ..... 439/607.41–607.52, 605.5, 452, 455, 577, 439/453, 607.01, 607.34, 607.54, 607.58, 439/660

See application file for complete search history.

(56) References Cited

U.S. PATENT DOCUMENTS

| | | | | |
|---|---|---|---|---|
| 5,409,400 | A * | 4/1995 | Davis | 439/607.48 |
| 5,716,236 | A * | 2/1998 | O'Sullivan et al. | 439/607.5 |
| 5,833,495 | A * | 11/1998 | Ito | 439/607.48 |
| 6,629,858 | B2 * | 10/2003 | Lo et al. | 439/607.56 |
| 6,705,894 | B1 * | 3/2004 | Comerci et al. | 439/607.47 |
| 6,739,883 | B1 * | 5/2004 | Cheng et al. | 439/98 |
| 6,783,397 | B2 * | 8/2004 | Yang Lee | 439/607.45 |
| 7,021,971 | B2 | 4/2006 | Chou et al. | |
| 7,104,848 | B1 | 9/2006 | Chou et al. | |
| 7,134,914 | B1 * | 11/2006 | Wu | 439/607.41 |
| 7,341,487 | B2 * | 3/2008 | Wu | 439/607.51 |
| 7,380,991 | B2 | 6/2008 | Schempp | |
| 7,470,150 | B2 * | 12/2008 | Kuo et al. | 439/607.41 |
| 7,479,037 | B2 * | 1/2009 | Bernat et al. | 439/607.41 |
| 7,534,143 | B1 * | 5/2009 | Tsao et al. | 439/607.41 |
| 2005/0159047 | A1 * | 7/2005 | Takahashi | 439/610 |

* cited by examiner

*Primary Examiner*—Michael C Zarroli
(74) *Attorney, Agent, or Firm*—Wei Te Chung; Andrew C. Cheng; Ming Cheih Chang

(57) ABSTRACT

A cable assembly (1) includes an insulative housing (2) having a base portion (21) and a tongue portion (22) extending forwardly from the base portion; a plurality of contact members supported by the insulative housing; a metal shell (8) having a tube-shaped mating frame enclosing the tongue portion therein; a cable (5) including a number of wire members for connecting to the contact members, a plurality of strength members (54) and an insulative jacket (55) enclosing the wire members and the strength members, and partial of front segment of the jacket removed away to have the strength members exposed outside; and a connection member (9) including a first engaging portion (91) connected to a second engaging portion (92), said strength members made into a strand and gripped by the first engaging portion, and said the second engaging portion securely attached to the metal shell.

20 Claims, 6 Drawing Sheets

CABLE ASSEMBLY HAVING ENHANCED INTERCONNECTION DEVICE THEREOF

CROSS-REFERENCE TO RELATED APPLICATIONS

This application is related to U.S. patent application Ser. No. 11/818,100, filed on Jun. 13, 2007 and entitled "EXTENSION TO UNIVERSAL SERIAL BUS CONNECTOR WITH IMPROVED CONTACT ARRANGEMENT", and U.S. patent application Ser. No. 11/982,660, filed on Nov. 2, 2007 and entitled "EXTENSION TO ELECTRICAL CONNECTOR WITH IMPROVED CONTACT ARRANGEMENT AND METHOD OF ASSEMBLING THE SAME", and U.S. patent application Ser. No. 11/985,676, filed on Nov. 16, 2007 and entitled "ELECTRICAL CONNECTOR WITH IMPROVED WIRE TERMINATION", all of which have the same assignee as the present invention.

BACKGROUND OF THE INVENTION

1. Field of the Invention

The present invention relates to a cable assembly, more particularly to a cable assembly with an enhanced interconnection means arranged between an electrical connector and a cable thereof to reinforce physical or mechanical connecting therebetween.

2. Description of Related Art

Recently, personal computers (PC) are used of a variety of techniques for providing input and output. Universal Serial Bus (USB) is a serial bus standard to the PC architecture with a focus on computer telephony interface, consumer and productivity applications. The design of USB is standardized by the USB Implementers Forum (USB-IF), an industry standard body incorporating leading companies from the computer and electronic industries. USB can connect peripherals such as mouse devices, keyboards, PDAs, gamepads and joysticks, scanners, digital cameras, printers, external storage, networking components, etc. For many devices such as scanners and digital cameras, USB has become the standard connection method.

USB supports three data rates: 1) A Low Speed rate of up to 1.5 Mbit/s (187.5 KB/s) that is mostly used for Human Interface Devices (HID) such as keyboards, mice, and joysticks; 2) A Full Speed rate of up to 12 Mbit/s (1.5 MB/s). Full Speed was the fastest rate before the USB 2.0 specification and many devices fall back to Full Speed. Full Speed devices divide the USB bandwidth between them in a first-come first-served basis and it is not uncommon to run out of bandwidth with several isochronous devices. All USB Hubs support Full Speed; 3) A Hi-Speed rate of up to 480 Mbit/s (60 MB/s). Though Hi-Speed devices are advertised as "up to 480 Mbit/s", not all USB 2.0 devices are Hi-Speed. Hi-Speed devices typically only operate at half of the full theoretical (60 MB/s) data throughput rate. Most Hi-Speed USB devices typically operate at much slower speeds, often about 3 MB/s overall, sometimes up to 10-20 MB/s. A data transmission rate at 20 MB/s is sufficient for some but not all applications. However, under a circumstance transmitting an audio or video file, which is always up to hundreds MB, even to 1 or 2 GB, currently transmission rate of USB is not sufficient. As a consequence, faster serial-bus interfaces are being introduced to address different requirements. PCI Express, at 2.5 GB/s, and SATA, at 1.5 GB/s and 3.0 GB/s, are two examples of High-Speed serial bus interfaces.

From an electrical standpoint, the higher data transfer rates of the non-USB protocols discussed above are highly desirable for certain applications. However, these non-USB protocols are not used as broadly as USB protocols. Many portable devices are equipped with USB connectors other than these non-USB connectors. One important reason is that these non-USB connectors contain a greater number of signal pins than an existing USB connector and are physically larger as well. For example, while the PCI Express is useful for its higher possible data rates, a 26-pin connectors and wider card-like form factor limit the use of Express Cards. For another example, SATA uses two connectors, one 7-pin connector for signals and another 15-pin connector for power. Due to its clumsiness, SATA is more useful for internal storage expansion than for external peripherals.

The existing USB connectors have a small size but low transmission rate, while other non-USB connectors (PCI Express, SATA, et al) have a high transmission rate but large size. Neither of them is desirable to implement modern high-speed, miniaturized electronic devices and peripherals. To provide a kind of connector with a small size and a high transmission rate for portability and high data transmitting efficiency is much desirable.

In recent years, more and more electronic devices are adopted for optical transmitter. It may be good idea to design a connector which is capable of transmitting an electrical signal and an optical signal. Someone has begun to conceive such kind of connector which is compatible of electrical and optical signals transmitting. The connector includes metallic contacts assembled to an insulated housing and several optical lenses bundled together and mounted to the housing too. A kind of hybrid cable includes wires and optical fibers are respectively attached to the metallic contacts and the optical lenses.

However, the optical fibers are too delicate to be damaged, and reliable physical and mechanical interconnection between the connector and the cable is desired.

BRIEF SUMMARY OF THE INVENTION

Accordingly, an object of the present invention is to provide a cable assembly which has an enhanced interconnection means/device between wires and a connector.

In order to achieve the above-mentioned object, a cable assembly in accordance with present invention comprises an insulative housing having a base portion and a tongue portion extending forwardly from the base portion; a plurality of contact members supported by the insulative housing; a metal shell having a tube-shaped mating frame enclosing the tongue portion therein; a cable including a number of wire members for connecting to the contact members, a plurality of strength members and an insulative jacket enclosing the wire members and the strength members, and partial of front segment of the jacket removed away to have corresponding wire members and strength members exposed outside; and a connection member including a first engaging portion connected to a second engaging portion, said strength members made into a strand and gripped by the first engaging portion, and said the second engaging portion securely attached to the metal shell.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
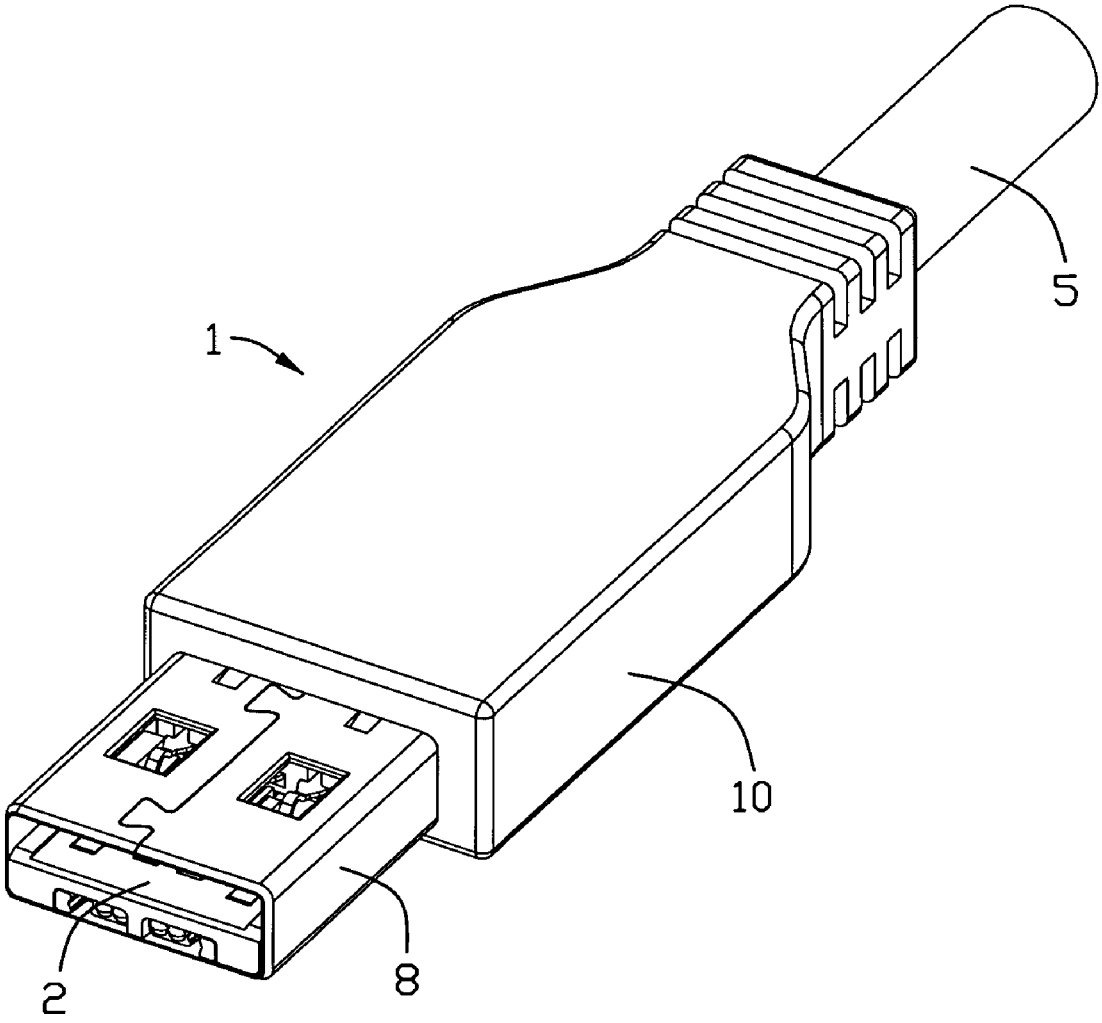
FIG. 1 is an assembled, perspective view of the cable assembly.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Figure 2:
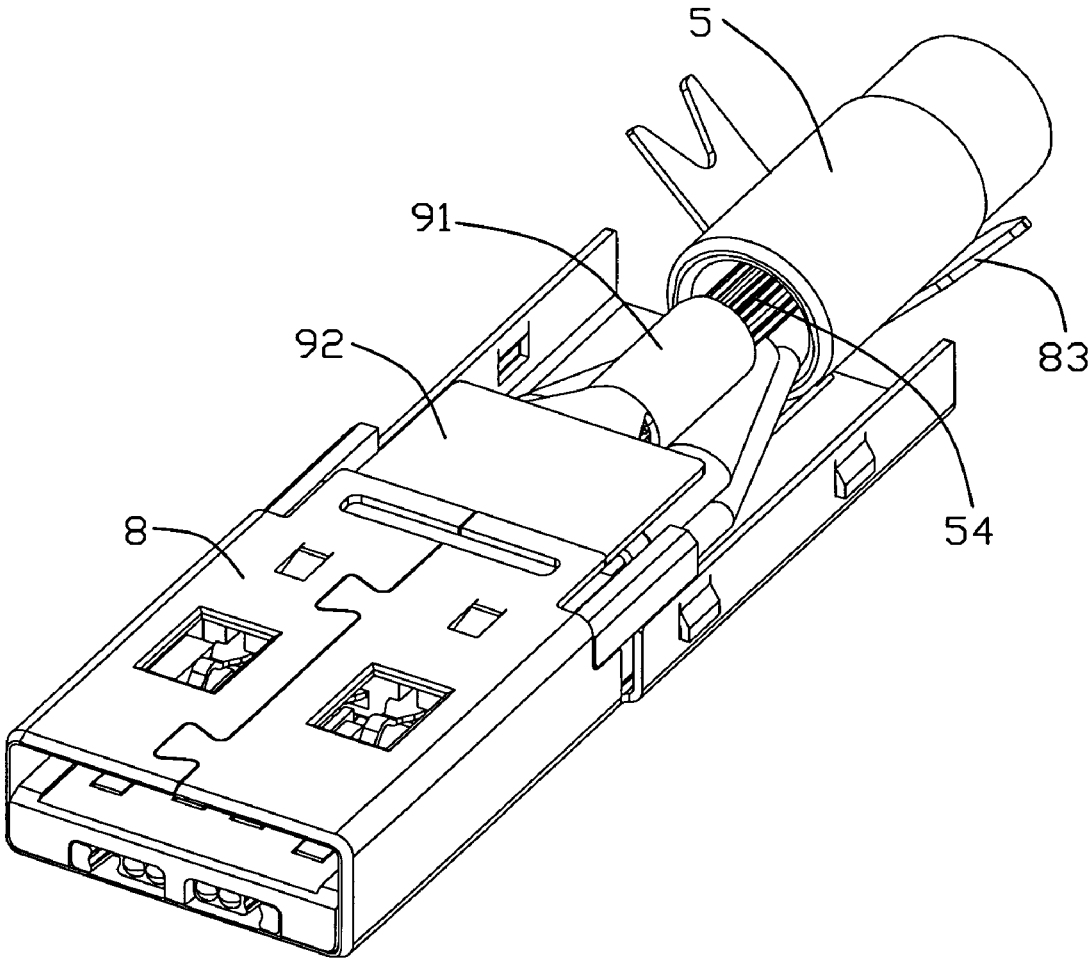
FIG. 2 is a partially assembled, perspective view similar to FIG. 1, with an outer cover and a metal part removed away.
Figure 3:
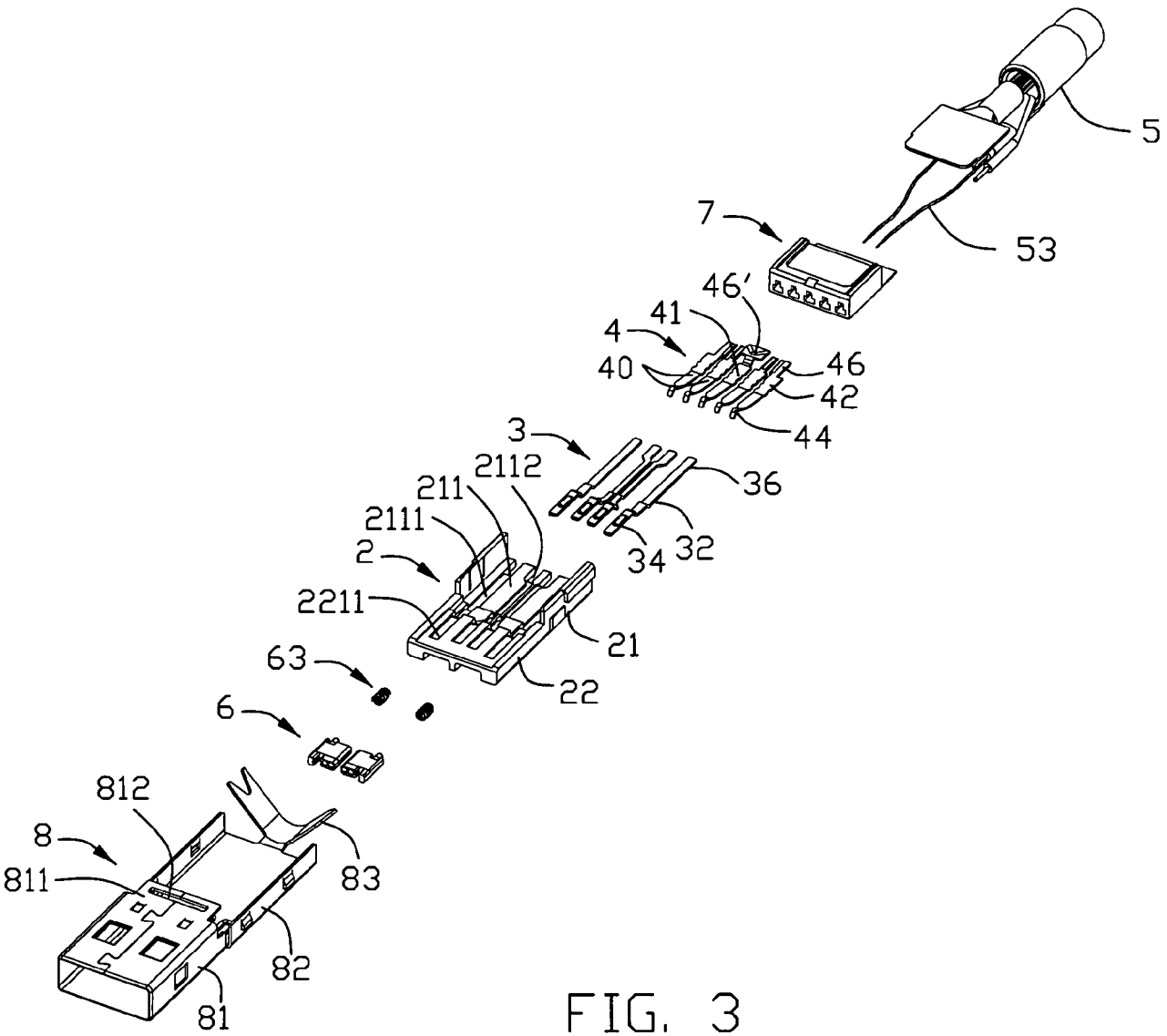
FIG. 3 is an exploded, perspective view of FIG. 2.
Figure 4:
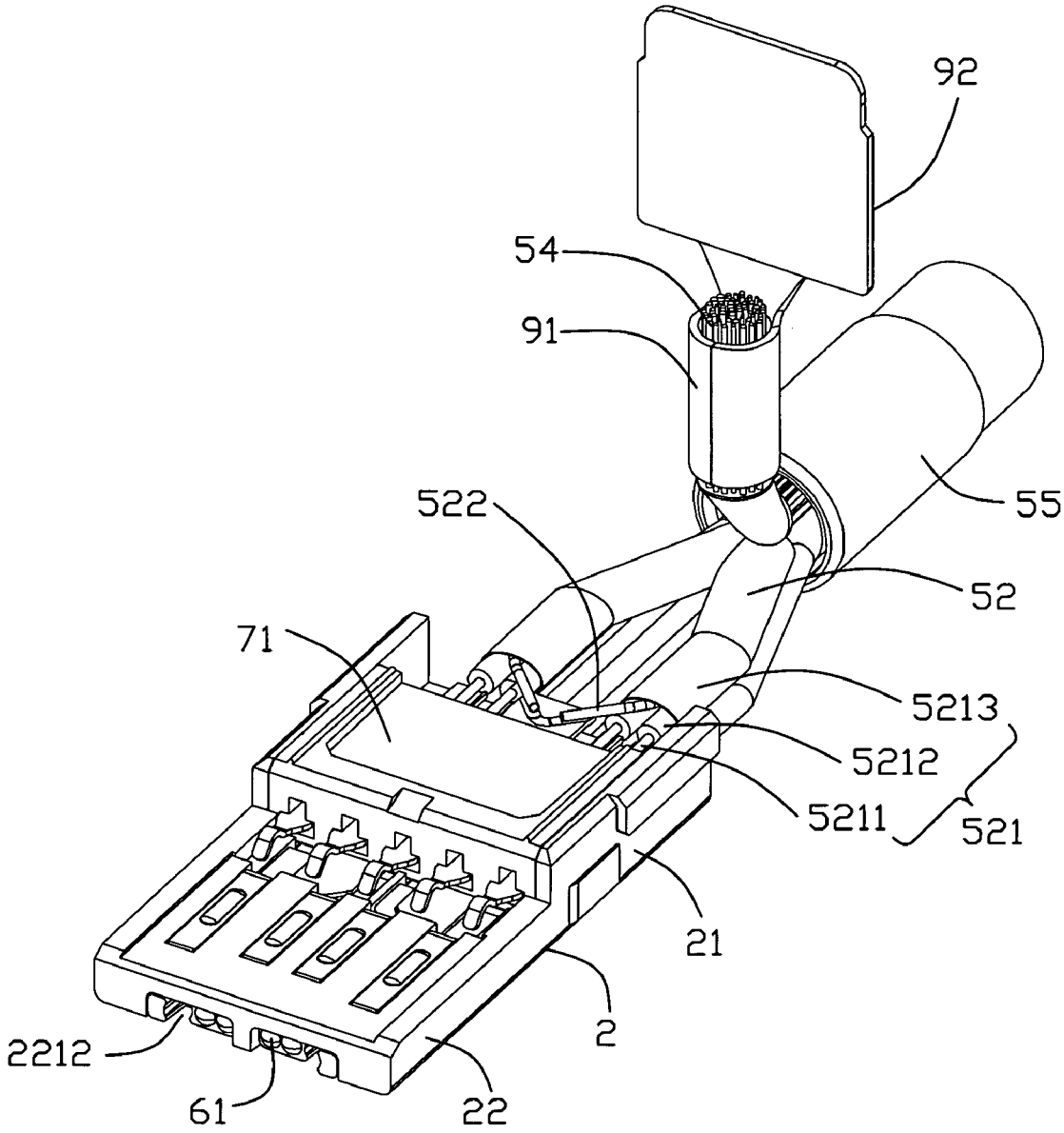
FIG. 4 is a partially assembled view of FIG. 3.
Figure 5:
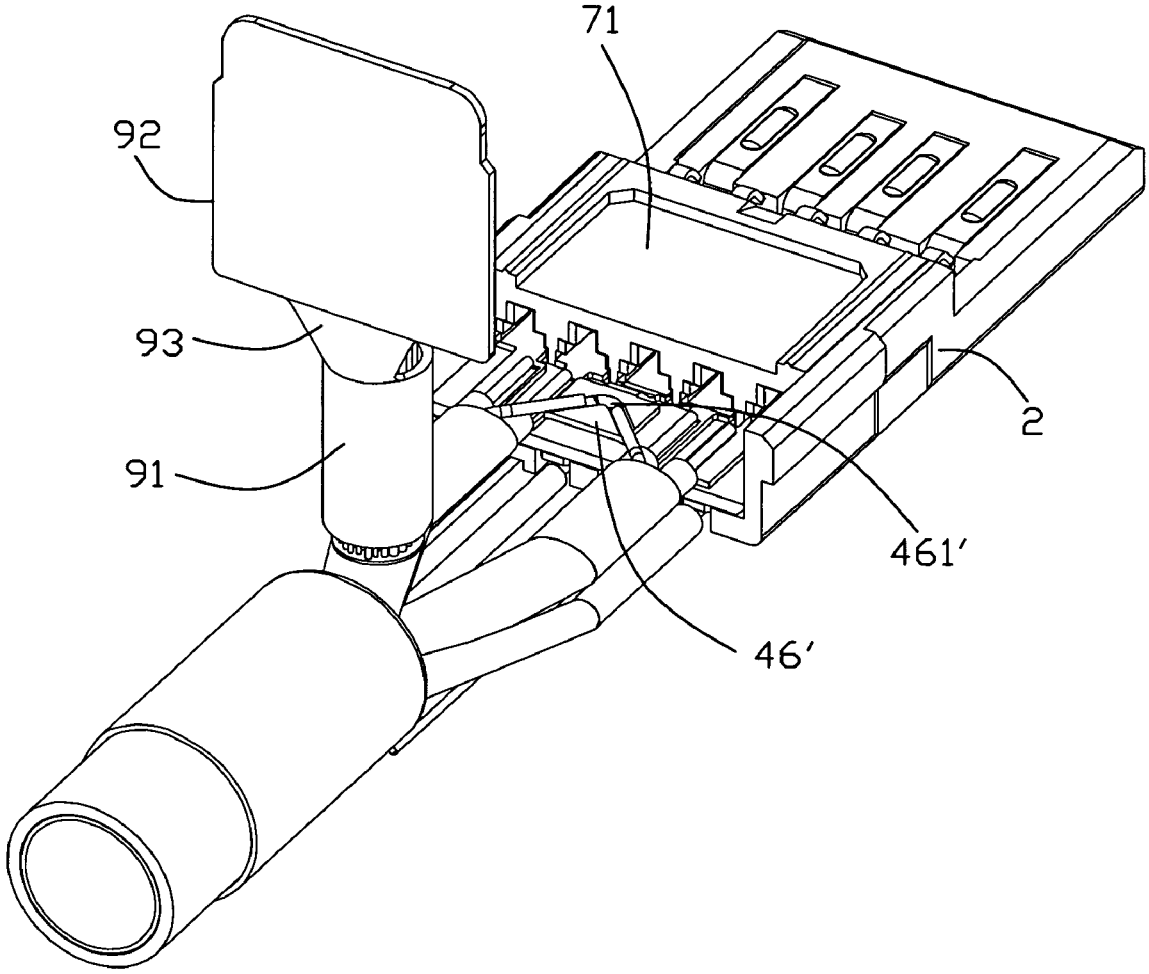
FIG. 5 is similar to FIG. 4, but viewed from other aspect.
Figure 6:
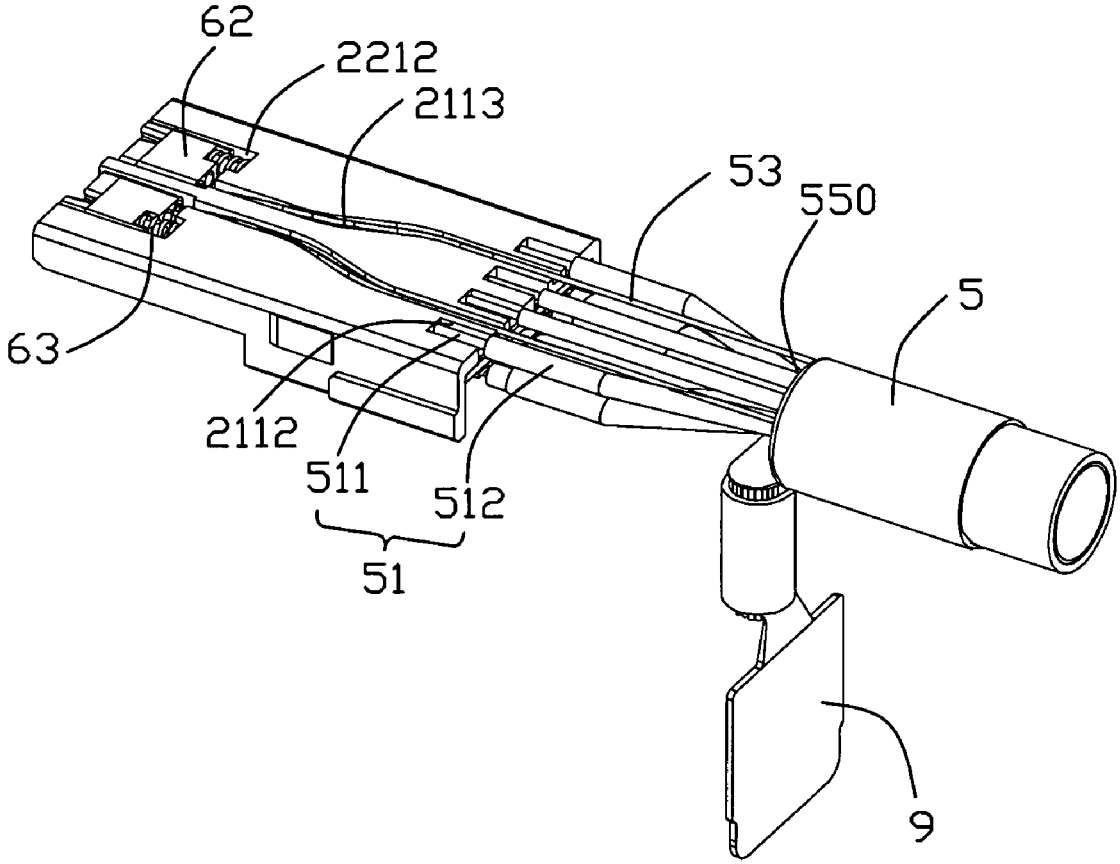
FIG. 6 is similar to FIG. 4, but viewed from another aspect.

Referring to FIGS. 1-6, a cable assembly 1 comprises an insulative housing 2, a set of first contacts 3, a set of second contacts 4 and two optical module 6 supported in the insulative housing 2, and a cable 5 connected to the first, second contacts 3, 4 and the optical module 6. The cable assembly 1 further comprises a metal shell 8 and a connection member 9. Detail description of these elements and their relationship and other elements formed thereon will be detailed below.

The insulative housing 2 includes a base portion 21 and a tongue portion 22 extending from the insulative base portion 21 in a front-to-rear direction. A cavity 211 is recessed downward from an up surface (not numbered) of the base portion 21, and four grooves 2111 are defined in a bottom portion of the cavity 211 and spaced apart one another along a transversal direction. Four supplemental grooves 2211 are recessed downward from an up surface (not numbered) of the base portion 22 and located in front of the four grooves 2111. The supplemental grooves 2211 are shorter than the four grooves 2111. Further, the four supplemental grooves 2211 are arranged higher than the four grooves 2111 along a vertical direction. Four slots 2112 are defined in a rear section of the base portion 21 and through a bottom surface (not numbered) of the base portion 21. The four slots 2112 are located behind of the four grooves 2111 and in communication thereto. Two mounting cavities 2212 are located in a lower segment of a front part of the tongue portion 22. Two curved slit 2113 are defined in a lower section of the insulative housing 2 and in communication to the two mounting cavities 2212, respectively.

The set of first contacts 3 has four contact members arranged in a row along the transversal direction and each first contact 3 substantially includes a planar retention portion 32 accommodated in the corresponding groove 2111, a mating portion 34 extending forward from the retention portion 32 and accommodated in the corresponding supplemental groove 2211, and a tail portion 36 extending rearward from the retention portion 32. Two of the first contacts 3 located in a second and positions of the first contacts row have same structure, and substantially same to those of other two first contacts 3, expect for a distance between the retention portions 32 of the two of the first contacts 3 are more smaller than a distance between mating portions 34 or tail portions 36 of the two of the first contacts 3.

The set of second contacts 4 has five contact members arranged in a row along the transversal direction and combined with an insulator 7 by inserted-mold process. The set of second contacts 4 are separated into two pair of signal contacts 40 for transmitting differential signals and a grounding contact 41 disposed between the two pair of signal contacts 40. Each the signal contact 4 includes a planar retention portion 42 received in the insulator 7, a curved mating portion 44 extending forward from the retention portion 42 and disposed beyond a front surface of the insulator 7, and a tail portion 46 extending rearward from the retention portion 42 and disposed rearward of a back surface of the insulator 7. The grounding contact 41 is similar to the signal contacts 40, except that the tail portions 46' thereof is much broader than the tail portion 46 of the signal contact 40. A V-shaped slot 461' is recessed downward from an up surface of the tail portion 46' of the grounding contact 41.

The insulator 7 is mounted to the cavity 211 of the base portion 21, with mating portions 44 of the second contacts 4 located behind the mating portions 34 of the first contacts 3 and above the up surface of the tongue portion 22, the tail portions 46, 46' of the signal contacts 40 and the grounding contact 41 disposed in a rear segment of the cavity portion 211 and higher than the tail portions 36 of the first contacts 3.

Each optical module 6 includes two lenses member 61 arranged in juxtaposed manner and enclosed by a holder member 62 and retained in the corresponding mounting cavity 2212. Furthermore, a pogo member (spring member) 63 is arranged between a back surface of the holder member 62 and back surface of the mounting cavity 2212.

The cable 5 includes a set of first wires 51, a set of second wires 52, a set of third wires (optical fibers) 53, a plurality of strength members 54, and an insulative jacket 55 enclosed outside of the first wires 51, the second wires 52, the third wires 53 and the strength members 54. The strength members 54 may be Kevlar members, fiberglass, and the like. A length of front segment of the insulative jacket 55 is removed to expose partial of wire members and the strength members 54 outside and disposed in front of a forward edge 550 of the insulative jacket 55.

Each first wire 51 has an inner conductor 511 and an insulative shielding portion 512 enclosing the inner conductor 511. A length of front segment of the insulative shielding portion 512 is deprived away to have the corresponding inner conductor 511 exposed outside. The inner conductor 511 is put into the slot 2112 and supported by the tail portion 36 therein, and then soldered to the tail portion 36.

Each second wire 52 has two sub-wires 521 to form differential pairs and a grounding wire 522 enclosed within a shielding member 5213. Each sub-wire 521 has an inner conductor 5211 and an insulative shielding portion 5212 enclosing thereon. A length of front segment of the insulative shielding portion 5212 is deprived away to have the corresponding inner conductor 5211 exposed outside. The inner conductor 5211 is supported by tail portion 46 of the second contacts 4 and soldered thereto. The grounding wires 522 are located in the V-shaped slot 461' of the tail portion 46' and soldered thereto.

The third wires (optical fibers) 53 are through slit 2113 defined in the insulative housing 2 and coupled to optical modules 6.

The metal shell 8 comprises a front tube-shaped mating frame 81, a rear U-shaped body section 82 connected to a bottom side and lateral sides of the mating frame 81, and a cable holder member 83 attached to a bottom side of the body section 82. An aperture 812 is defined in a rear segment of an up side 811 of the mating frame 81. The metal shell 8 may further comprises a supplemental part (not shown) which is similar to the U-shaped body section 82. The supplemental part is assembled to the body section 82 to shield the connection member 9. The cable holder member 83 is crimped to the insulative jacket 55 the cable 5.

The connection member 9 includes a sleeve-shaped first engaging portion 91, a planar shaped second engaging portion 92 and an inclined transition portion 93 interconnecting the first engaging portion 91 and the second engaging portion 92. The strength members 54 exposed outside are woven together/collected together to form a stand and gripped by the first engaging portion 91. The second engaging portion 92 is inserted into a depression portion 71 in the insulator 7 and located under the rear segment of the up side 811. Then the second engaging portion 92 and the rear segment of the up side 811 are combined together by laser weld process applied to the aperture 812. However, the second engaging portion 92 may secured to the metal shell 8 by other means/method, for example, a hook member (not shown) formed on the second engaging portion 92 may lock into the aperture or other part of the metal shell 8, or a bolt/screw member may be applied to lock the second engaging portion 92 and metal shell 8 or the insulative housing 2 together.

The cable assembly 1 further comprises an insulative cover 10 enclosing the metal shell 1 and partial of insulative jacket 55 of the cable 5.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

We claim:

1. A cable assembly, comprising:

an insulative housing having a base portion and a tongue portion extending forwardly from the base portion;

a plurality of contact members supported by the insulative housing;

a metal Shell having a tube-shaped mating frame enclosing the tongue portion therein;

a cable including a number of wire members for connecting to the contact members, a plurality of strength members and an insulative jacket enclosing the wire members and the strength members, and part of the front segment of the jacket is removed away to have corresponding wire members and strength members exposed outside; and a connection member including a first engaging portion connected to a second engaging portion, said strength members made into a strand and gripped by the first engaging portion, and said the second engaging portion securely attached to the metal shell.

2. The cable assembly as claimed in claim 1, wherein the second engaging portion of the connection member is soldered to the metal shell.

3. The cable assembly as claimed in claim 2, wherein the second engaging portion is disposed below a rear portion of a top side of the mating frame.

4. The cable assembly as claimed in claim 3, wherein the second engaging portion is accommodated in a depression portion defined in an upper section of the base portion.

5. The cable assembly as claimed in claim 2, wherein the first engaging portion connected to the second engaging portion via an inclined transition portion.

6. The cable assembly as claimed in claim 1, wherein the contact members include a set of first contacts and other sets of second contacts.

7. The cable assembly as claimed in claim 6, wherein a cavity is recessed downward from an upper surface of the base portion, and a number of grooves are defined in a lower portion of the cavity.

8. The cable assembly as claimed in claim 7, wherein each first contact has a retention portion accommodated in the corresponding groove.

9. The cable assembly as claimed in claim 8, wherein a number of supplemental grooves are defined in an upper section of the tongue portion, and each first contact has a mating portion accommodated in the corresponding supplemental groove.

10. The cable assembly as claimed in claim 8, wherein a number of slots are defined in a rear part of the cavity and in communication to a bottom peripheral of the base portion, and the each first contact has a tail portion disposed in the corresponding slot, wherein an inner conductor of the corresponding wire member is put into the corresponding slot and soldered to the tail portion.

11. The cable assembly as claimed in claim 7, wherein the second contacts are arranged in a row and combined with an insulator which is accommodated in the cavity.

12. The cable assembly as claimed in claim 11, wherein the second contacts have mating portions extending beyond a front surface of the insulator and disposed behind the mating portions of the first contacts.

13. The cable assembly as claimed in claim 12, wherein the mating portion of the second contacts are curve shaped and located above an upper surface of the tongue portion.

14. The cable assembly as claimed in claim 11, wherein the second contacts includes two pair of signal contacts for transmitting differential signals and grounding contacts disposed between the two pair of signal contacts.

15. The cable assembly as claimed in claim 14, wherein a tail portion of the grounding contact is broader than the tail portion of the each signal contact.

16. The cable assembly as claimed in claim 1, wherein the second engaging portion of the connection member latches with the metal shell.

17. A cable assembly, comprising:

an insulative housing having a base portion and a tongue portion extending forwardly from the base portion;

a plurality of contacts supported by the insulative housing;

a metal shell having a tube-shaped mating frame enclosing the tongue portion therein;

a cable including a number of wire members for connecting to the contact members, a plurality of strength members and an insulative jacket enclosing the wire members and the strength members, and part of the front segment of the jacket is removed away to have corresponding wire members and strength members exposed outside; and a connection member including a first engaging portion connected to a second engaging portion, said strength members gripped by the first engaging portion, and said the second engaging portion fastened to the base portion of the insulative housing.

18. The cable assembly as claimed in claim 17, wherein the second engaging portion is arranged between an upper side of the mating frame and sunken portion located in an upper section of the base portion.

19. A cable connector assembly comprising:

an insulative housing defining a plurality of first passageways extending along a front-to-back direction and exposed on a top side of the housing;

a metallic shell covering said housing;

a plurality of first contacts disposed in the corresponding first passageways, respectively, each of said first contacts defining a first front contacting section exposed upon the top side in an upward direction, and a first rear soldering section exposed in a downward direction;

an insulator positioned upon a rear region of the top side of the housing and defining a plurality of second contacts, each of said second contacts defining a second front contacting section exposed upon the top side of the housing in said upward direction and located behind the first contacting section, and a second rear soldering section exposed in said upward direction; and a cable including a plurality of first wires respectively soldered to the corresponding first rear soldering sections, and a plurality of second wires respectively soldered to the corresponding second rear soldering sections; wherein said cable further includes a plurality of dielectric strength members which are grouped as a bundle independently grasped by a metallic connection member which is engaged with the shell; wherein the first contacting section is stiff while the second contacting section is resilient.

20. The Cable connector assembly as claimed in claim 19, wherein the metallic connection member includes a plate received in a recess in the insulator and engaged with the shell in opposite directions.

* * * * *